US005827141A

United States Patent [19]

Lukey et al.

[11] Patent Number: 5,827,141

[45] Date of Patent: Oct. 27, 1998

[54] STICK BLADE

[76] Inventors: Roderick Lukey, 5 Ramey St., St. Catharines, Ontario, Canada, L2N 2K2; Tony Napolitano, 87 Lakeport Road, St. Catharines, Ontario, Canada, L2N 4P9

[21] Appl. No.: 769,876

[22] Filed: Dec. 19, 1996

[51] Int. Cl.[6] ..... A63B 59/12

[52] U.S. Cl. ..... 473/563

[58] Field of Search ..... 473/563, 189

[56] References Cited

U.S. PATENT DOCUMENTS 3,561,760 2/1971 Klay ..... 473/563

FOREIGN PATENT DOCUMENTS 1383949 2/1975 Canada ..... 473/189

*Primary Examiner*—Mark S. Graham

[57] ABSTRACT

The present invention relates to a blade for a hockey stick, said blade being planar and having front and rear surfaces having top, side and bottom edges. The thickness of the blade is thin relative to its width and height The front and rear surfaces can be flat or curved. A first side edge of said blade is adapted for connection of a shaft to the blade adjacent the juncture of the first edge and said top edge. A second side edge generally parallel to the first side edge is provided remote from said point of attachment of said shaft. A perimeter ridge is provided on the back surface of said blade from the bottom edge up said second side edge, along said top edge and down said first side edge.

8 Claims, 4 Drawing Sheets

STICK BLADE

BACKGROUND OF THE INVENTION

1. Field of the Invention

This invention relates to improvements in the design of the blade of sticks, and in particular the blade of hockey sticks, rowing oars, paddles and the like.

2. Description of the Prior Art

Today manufacturers make blades for hockey sticks, rowing oars and the like as thin as possible so as to reduce the overall weight and cost. This practice has adverse affects on durability, as a reduction in the cross-sectional area of a blade ultimately leads to a reduction in strength. Manufacturers have experimented with various materials to help prevent breakage and excessive wear. These materials include fiberglass, resin, graphite composites, tapes and various approaches of wood lamination. For example some blades for hockey sticks have a piece of Teflon or plastic running along the bottom edge of the blade, adding to the stick's durability. See also U.S. Pat. No. 4,955,839 for improvements in the construction of sculling oars.

A rounded profile on the toe of the blade seems to have been one of the few attempts at improving a hockey stick's playability features and performance. This modification permits easier play along the boards because the rounded corners have less tendency to get caught up in the rough ice that gets built up along the boards during the coarse of most hockey games.

U.S. Pat. No. 3,563,546 describes a hockey stick blade having a shoulder extending vertically along the toe of the blade thereby providing a puck cradling bay on the backhand surface of the blade to deter the puck from sliding off the end of the stick.

SUMMARY OF THE INVENTION

It is an object of the invention to provide a means to increase the strength and durability of the blade of a hockey stick, rowing oar or the like.

It is a further object of the invention to provide a blade for a hockey stick, rowing oar the like that increases performance.

It is a further object of the invention to provide a blade for a hockey stick that increases stick handling performance and shooting accuracy.

It is a further object of the invention to provide a blade for a rowing oar, paddle or the like that improves strength and performance.

Thus in accordance with the present invention there is provided a blade for a hockey stick, rowing oar, paddle or the like, said blade being planar and having front and rear surfaces having top, side and bottom edges. The thickness of the blade is thin relative to its width and height The front and rear surfaces can be flat or curved. A first side edge of said blade is adapted for connection of a shaft to the blade adjacent the juncture of the first edge and said top edge. A second side edge generally parallel to the first side edge is provided remote from said point of attachment of said shaft. A perimeter ridge is provided on the back surface of said blade from the bottom edge up said second side edge, along said top edge and down said first side edge.

In a preferred embodiment the present invention comprises a blade for a hockey stick said blade extending from a heel end to a toe end and with front and rear surfaces having top and bottom edges extending from said heel end to said toe end, wherein a perimeter ridge is provided on the back surface of said blade from the bottom edge adjacent said toe end around said toe end along said top edge and around the heel end of said blade.

The perimeter ridge incorporated into the blade design according to the present invention, adds increased strength and makes the blade more rigid. Particular attention is paid to the reinforcement of the first and second edges (heel and toe in a hockey stick) where the added perimeter ridge gives additional support to these areas, countering the constant contact of the blade with the playing surface or water. The added strength and support to the second edge (toe) of the blade also helps to prevent chipping, cracking and excessive wear.

While conventional hockey stick blades tend to bend or flex when the blade makes contact with the puck or ball, blade of the present invention retains it's shape through the shot because the perimeter ridge adds support, strength and stability at the top of the blade.

Most hockey stick blade designs are wedge shaped where the bottom of the blade is thicker than the top. The upper/outer perimeter ridge design of our blade thickens the top and outer edges of the blade, which in turn acts as a counterbalance, offsetting the thickened bottom portion of the blade, giving the blade and stick as a whole a unique "feel".

The hockey stick blade of the present invention increases puck, ball and stick handling abilities. With this design the puck or ball has less tendency to run off the heel or toe of the blade because of the perimeter ridge. Shot accuracy is also increased dramatically. The perimeter ridge acts a natural counterbalance forcing the wrists to roll during the follow through portion of shooting. This action develops the follow-through so as to allow the player to point the tip of the blade at the target, which is the key to accurate shooting.

Roaring oars, paddles and the like when equipped with the present invention create more resistance between the oar and the water during the stroke thereby increasing strength and performance.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
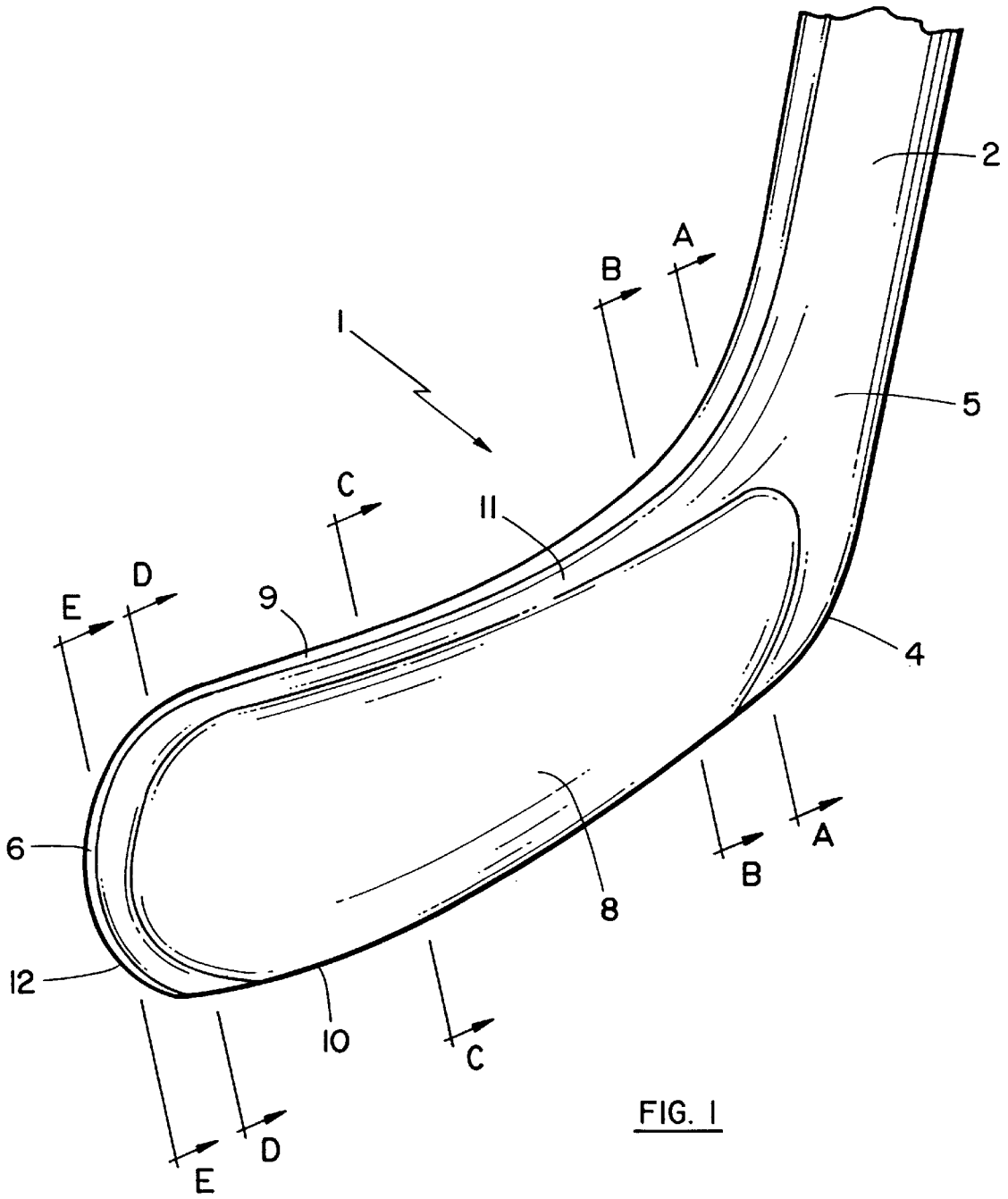
FIG. 1 is a perspective view of the back surface of a hockey stick blade according to the present invention.

Referring to FIG. 1, the blade of a hockey stick according to the present invention is generally indicated at 1. The blade 1 is adapted to be attached to a shaft 2 to form a hockey stick. The shaft 2 may vary in length and manner of construction to suit individual needs. Also the blade 1 may be integrally connected to the shaft or may be a replaceable blade designed to fit in the open end of a tubular shaft usually made of aluminum, graphite or composite materials for strength, lightness and durability.

The blade 1 extends from a heel end 4, adjacent to the point of attachment 5 to shaft 2, to a toe end 6 and is provided with front 7 and back 8 surfaces having top 9 and bottom 10 edges extending between said ends. The bottom edge 10 adjacent the heel end 4 is generally thickened to give added strength and support to the blade 1. A perimeter ridge 11 is provided on the back surface 8 of blade 1 from the bottom edge 10 adjacent said toe end 6, up the edge 12 of said toe end 6, along said top edge 9 and around said heel end 4.

The adding of a perimeter ridge 11 to the blade 1 increases the blade's stability by helping the blade to maintain it's form at the time of shot impact. In other words the blade does not have a tendency to bend or give, as a conventionally designed blade would during shot impact. The increase in stability also adds to an increase in blade strength and durability.

The increase in material needed to create the perimeter ridge 11 adds to the strength of the blade in each of the three main portions of the blade: the heel, mid-blade, and the toe. The heel receives the largest increase in cross-sectional area, adding strength to a portion of the blade that traditionally breaks prematurely. The durability of the heel is increased as the progressive wear on the heel is substantially less than that of a conventionally designed blade. The ridge at the mid portion of the blade contributes to its stiffness resulting in greater stability under load. Chipping and cracking at the toe caused by repeated contact with the ball or puck, playing surfaces, boards and other players sticks is decreased due to the added material resulting from the perimeter ridge design.

The perimeter ridge also creates what is known as a "sweet spot" on the blade. At shot impact the resulting torsion waves are concentrated to and at the center of the blade because the perimeter ridge helps prevent the waves from leaving or migrating out the edge of the blade. The perimeter ridge also acts as a counter-balance, creating a unique "feel" to the balance of the blade and the stick as a whole.

The perimeter ridge design also increases puck or ball handling ability. The perimeter ridge at the toe and heel ends help eliminate the tendency for the puck or ball to run off the end of the blade. The continuous top ridge of the blade at the mid-section prevents the puck or ball from hopping or jumping over the blade while a player is stick-handling. It should also be noted that stick-handling and shot accuracy is aided and increased as a result of the perimeter ridge. The counter-balance effect of the perimeter ridge assists the player in developing stick handling techniques and a proper shot follow through technique.

Figure 2:
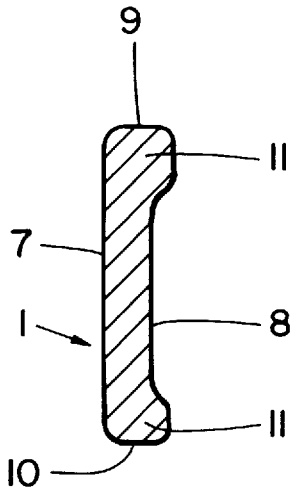
FIG. 2 is a cross section along line A—A of the heel end of the blade of FIG. 1.

FIG. 2 is a cross section along line A—A of the heel end 4 of the blade 1 of FIG. 1. The front surface 7 of the blade 1 is generally straight and perimeter ridge 11 adds material to the back surface 8 of the blade at the top edge 9 and the bottom edge 10. The perimeter ridge 11 does not extend along the entire length of the bottom edge 10.

Figure 3:
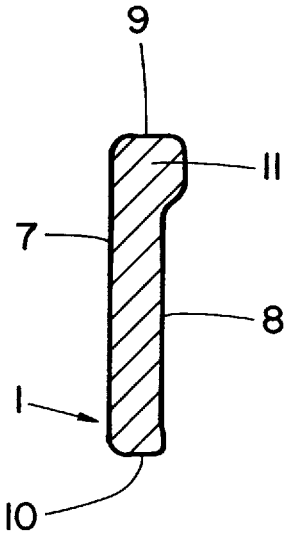
FIG. 3 is a cross section along line B—B of the forward portion of the heel end of the blade of FIG. 1.

In the preferred embodiment, as illustrated in FIG. 3, the perimeter ridge 11 is provided around the heel end 4 but only extends a very short distance along bottom edge 10 where the puck or ball is normally not in contact with the back surface of the blade. The thickness of the perimeter ridge 11 may vary along the length of the blade. As noted previously in the preferred embodiment the heel end receives the largest increase in material. The thickness of the blade is generally tapered slightly from heel end to toe end and the thickness of the perimeter ridge can likewise be tapered.

Figure 4:
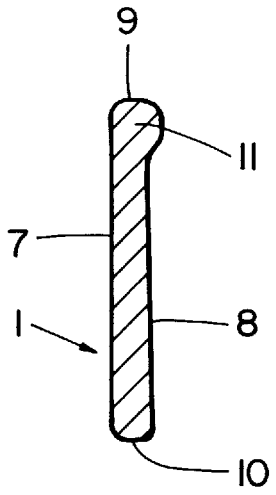
FIG. 4 is a cross section along line C—C of FIG. 1.

FIG. 4 is a sectional front view of the middle of the blade where it shows in the thickness of the perimeter ridge 11 being less than around the heel end.

Figure 5:
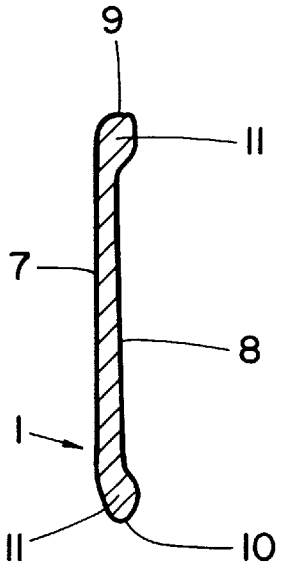
FIG. 5 is a cross section along line D—D of the mid portion of the toe end of the blade of FIG. 1.

FIG. 5 is a cross sectional view along line D—D in FIG. 1 featuring the toe end 6 of the blade where it shows the perimeter ridge 11 at the top edge 10 and also along the bottom edge 9 where the perimeter ridge 11 is continued around the entire toe end 6 of the blade 1.

Figure 6:
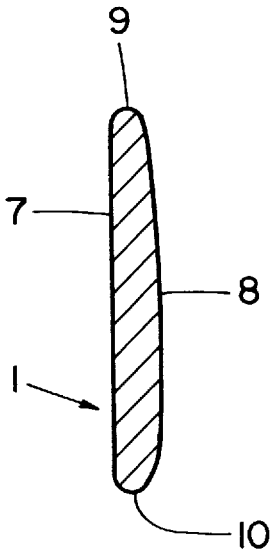
FIG. 6 is a cross section along line E—E of the toe end of the blade of FIG. 1.

FIG. 6 is a sectional view of the toe end 6 of the blade along line E—E showing how perimeter ridge 11 extends around the toe end 6 on edge 12.

Figure 7:
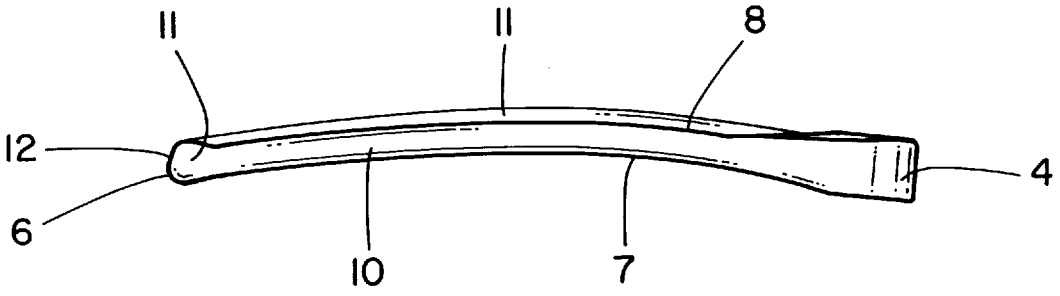
FIG. 7 is a plan view of the bottom edge of the blade of FIG. 1.

FIG. 7 is a plan view of the bottom edge 9 of the blade 1. The perimeter ridge 11 around the heel end 4 merges and blends into shaft 2. The perimeter ridge 11 on top edge 10 of the blade 1 blends around the toe end 6 of the blade 1.

In the preferred embodiment the perimeter ridge 11 varies in width from about ¼ inch to ½ inch. The ridge is about 3⁄16 to ⅛ inch thick.

Figure 8:
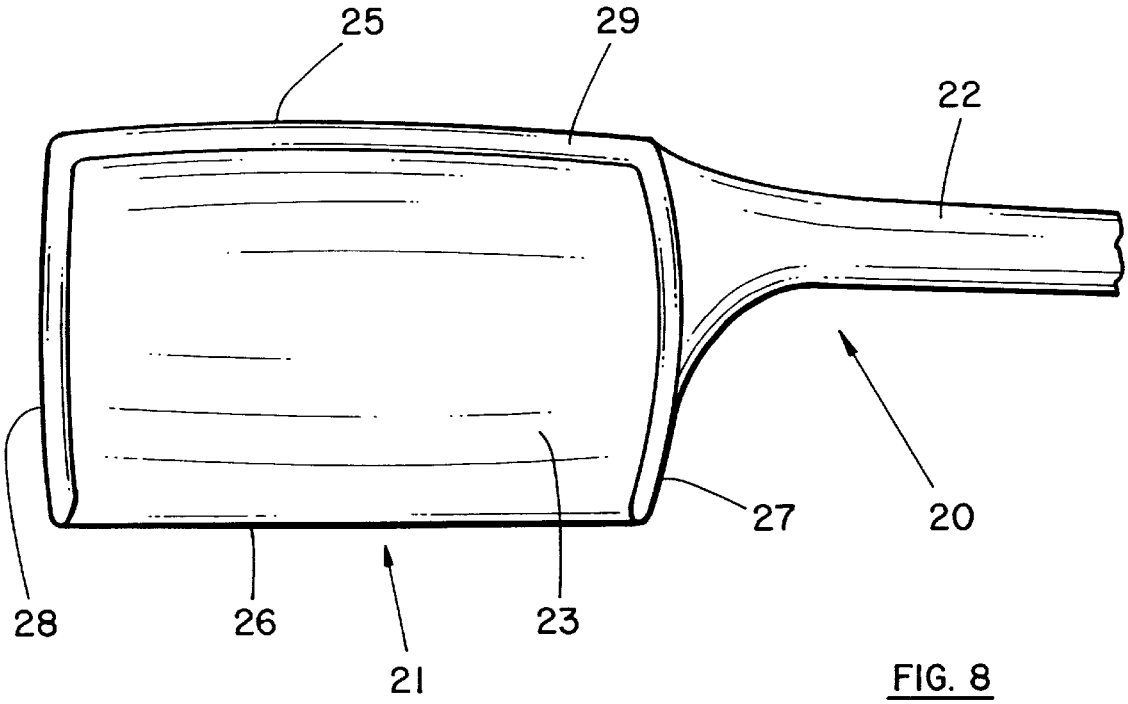
FIG. 8 is a plan view of the back surface of a hatchet style blade of a rowing oar according to the present invention.
Figure 9:
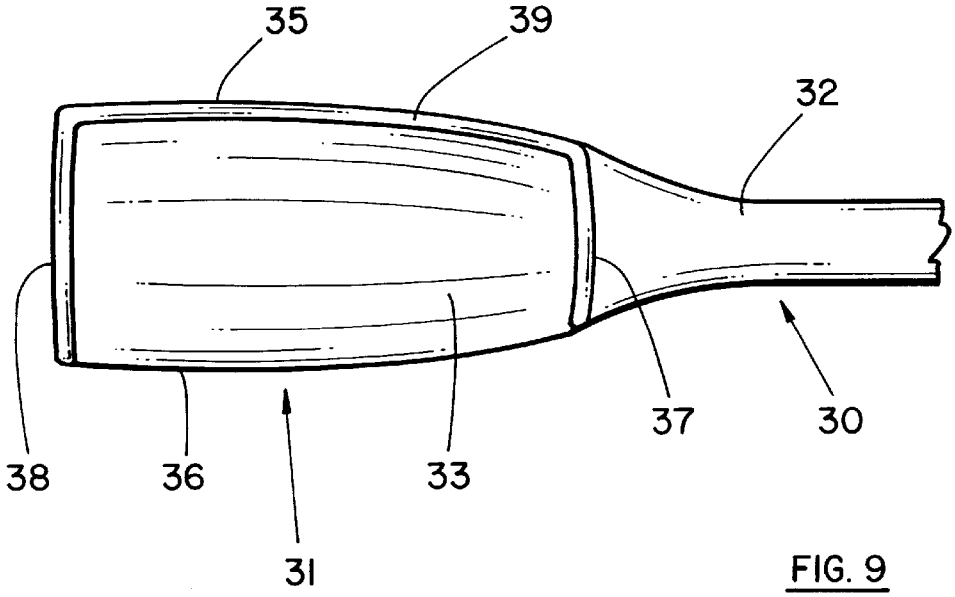
FIG. 9 is a plan view of the back surface of a traditional style blade of a rowing oar according to the present invention.

FIGS. 8 and 9 illustrate the use of the present invention in connection with a rowing oar. In FIG. 8, the rowing oar generally indicated at 20 consists of a blade 21 and shaft 22. The blade 21 has a concave back surface 23 and a convex front surface. The front surface faces the direction of travel of the boat being rowed. The blade 21 has top and bottom edges 25 and 26 respectively. A first side edge 27 of the blade 21 is connected to shaft 22. The second side edge 28 is generally parallel to the first side edge 27. FIG. 8 illustrates a "hatchet" style blade where the shaft 22 is connected to the first side edge 27 of the blade 21 near its top edge 25. A perimeter ridge 29 is provided on the back surface 23 from the bottom edge 26 up the second side edge 28, along said top edge 25 and down the first side edge 27.

FIG. 9 illustrates a more traditional blade for a rowing oar. The rowing oar generally indicated at 30 consists of a blade 31 and shaft 32. The blade 31 has a concave back surface 33 and a convex front surface. The front surface faces the direction of travel of the boat being rowed. The blade 31 has top and bottom edges 35 and 36 respectively. A first side edge 37 of the blade 31 is connected to shaft 32. The second side edge 38 is generally parallel to the first side edge 37. FIG. 8 illustrates a traditional style blade where the shaft 22 is connected to the first side edge 37 of the blade 31 near its mid point. A perimeter ridge 39 is provided on the back surface 33 from the bottom edge 36 up the second side edge 38, along said top edge 35 and down the first side edge 37.

The increase in material needed to create the perimeter ridge 29 adds to the strength of the blade in each of the three main portions of the blade: adjacent the juncture with the shaft, mid-blade, and second or leading edge. The area adjacent the juncture with the shaft receives the largest increase in cross-sectional area, adding strength to a portion of the blade that traditionally breaks prematurely. The ridge at the mid portion of the blade contributes to its stiffness resulting in greater stability under load. The perimeter ridge also in conjunction with the concave rear surface tends to result in increased load during the stroke. The blade therefore becomes an excellent training tool as it builds strength and endurance.

Additions and modifications to the apparatus as described above can be made without departing from the scope of the present invention.

Having illustrated and described a preferred embodiment of the invention and certain possible modifications thereto, it should be apparent to those of ordinary skill in the art that the invention permits of further modification in arrangement and detail. All such modifications are covered by the scope of the invention.

The embodiments of the invention in which an exclusive property or privilege is claimed are defined as follows:

1. A blade for a hockey stick, said blade having front and rear surfaces and top, first side, second side and bottom edges, wherein the first side edge of said blade is adapted for connection of a shaft to the blade adjacent the juncture of the first side edge and said top edge, the front surface of said blade is a generally smooth concave surface and said rear surface is generally convex, said front and rear surfaces tapering towards said second side edge, a perimeter ridge provided only on the back surface of said blade, said perimeter ridge extending up said second side edge, along said top edge and down said first side edge but not along the bottom edge of the blade.

2. A blade for a hockey stick, said blade extending from a heel end to a toe end and with front and rear surfaces having top and bottom edges extending from said heel end to said toe end, wherein said front surface of said blade is a generally smooth concave surface, and said rear surface is generally convex, said front and rear surfaces tapering towards said second side edge, a perimeter ridge provided only on the back surface of said blade, said perimeter ridge extending around said toe end along said top edge and around the heel end of said blade but not along the bottom edge of the blade.

3. A blade according to claim 2 wherein the perimeter ridge is thicker at the heel end than at the toe end of the blade.

4. A blade according to claim 2 wherein said blade is adapted to be integrally connected to the shaft of a hockey stick.

5. A blade according to claim 2 wherein said blade is adapted to be inserted in the open end of a tubular shaft of a hockey stick.

6. A blade according to claim 2 wherein the perimeter ridge is ¼ to ½ inch in width.

7. A blade according to claim 6 wherein the perimeter ridge is 3⁄16 to ⅛ inch thick.

8. A hockey stick, including a blade portion and a shaft portion connected to said blade, said blade further including a front face and a rear face defined by top and bottom peripheral edges extending between heel and toe portions of said blade, said front face of said blade being generally concave in configuration throughout its length and presenting a generally smooth facial surface, said rear face being generally convex and including an interrupted perimetric ribbed edge extending across the rear face of said blade from the heel to the toe to partially encircle the rear face of said blade, the rib of said ribbed edge tapering in width and height from said heel to said toe, and wherein the rear face of said blade within said perimetric rib is substantially parallel with the front face of said blade.

* * * * *